US008240951B2

(12) United States Patent
Gainey, Sr. et al.

(10) Patent No.: US 8,240,951 B2
(45) Date of Patent: Aug. 14, 2012

(54) DIVERTING STORM SURGE-APPARATUS AND METHOD

(76) Inventors: Russell H. Gainey, Sr., Knoxville, AL (US); Darla K. Rooks, Kiln, MS (US)

( * ) Notice: Subject to any disclaimer, the term of this patent is extended or adjusted under 35 U.S.C. 154(b) by 281 days.

(21) Appl. No.: 12/384,263

(22) Filed: Apr. 2, 2009

(65) Prior Publication Data

US 2010/0254765 A1 Oct. 7, 2010

(51) Int. Cl.
*E02B 7/40* (2006.01)

(52) U.S. Cl. ..... 405/96; 405/87; 405/92; 405/99

(58) Field of Classification Search ..... 405/87, 405/88, 89, 90, 92, 94, 95, 96, 99, 100, 106
See application file for complete search history.

(56) References Cited

U.S. PATENT DOCUMENTS 1,634,697 A * 7/1927 Thorsby ..... 251/147
4,091,624 A * 5/1978 Steinke ..... 405/96
4,963,057 A * 10/1990 Fournier ..... 405/93
6,338,594 B1 * 1/2002 Adler et al. ..... 405/97
6,779,947 B1 * 8/2004 Buchanan et al. ..... 405/99

FOREIGN PATENT DOCUMENTS

WO WO 2007104917 A1 * 9/2007

* cited by examiner

*Primary Examiner* — David Bagnell
*Assistant Examiner* — Benjamin Fiorello
(74) *Attorney, Agent, or Firm* — John W. Carpenter

(57) ABSTRACT

An aqueduct assembly is provided as having a front gate assembly and a rear gate assembly. The front gate assembly has a front gate which will open to let water into the aqueduct assembly. When water begins to rise in the aqueduct assembly, a rear gate of the rear gate assembly opens to let water flow out of the aqueduct assembly. A method for diverting water is also provided. A front gate assembly opens for allowing water to flow into the aqueduct assembly. Subsequently, rear gate assembly opens for permitting water to flow out of the aqueduct assembly.

20 Claims, 10 Drawing Sheets

DIVERTING STORM SURGE-APPARATUS AND METHOD

FIELD OF THE INVENTION

Embodiments of the present invention are related to an apparatus and method for diverting a surge of water caused by a storm, or any occurrence that causes water to precariously rise. More specifically, embodiments of the present invention provide an apparatus (i.e., an aqueduct assembly) and method for protecting people, property, and animal life, located behind levees by channeling water into the apparatus, and channeling the water from the apparatus onto a desired location, such as marsh land.

BACKGROUND OF THE INVENTION

A hurricane, such as Katrina, in the Gulf of Mexico, can cause water levels to rise well above normal, especially in coastal areas. When this occurs near the mouth of a river, such as the Mississippi river, water levels in the river can rise to dangerous levels.

Water from a body of water (e.g., the Gulf of Mexico) into which the river empties, is forced up the river, colliding with water flowing down the river and towards the body of water. This causes water pressure against levees to increase, to the point of either flowing over the levees and/or bursting the levees to endanger people, property, and animal life, located behind levees. What is needed is a storm-surge apparatus which will alleviate, or eliminate, the water pressure against the levees.

SUMMARY OF EMBODIMENTS OF THE INVENTION

Embodiments of the present invention provide an aqueduct assembly having a front gate assembly and a rear gate assembly. A front gate of the front gate assembly will open in accordance with the level of water coming in contact with it. As the front gate opens, water enters the aqueduct assembly. When water begins to rise in the aqueduct assembly, a rear gate of the rear gate assembly begins to open. As the rear gate opens, water in the aqueduct assembly begins to flow out of the aqueduct assembly onto any desired land, such as marsh land.

Embodiments of the present invention also provide a method for diverting water from a body of water onto land. The method includes elevating a front gate assembly for allowing water to flow into an aqueduct assembly, and subsequently elevating a rear gate assembly for permitting water to flow out of the aqueduct assembly. In an embodiment of the invention, the method further includes disengaging a front flotation device from a front gate to prevent water from flowing into the aqueduct assembly, and opening a valve member to permit water to flow into the aqueduct assembly and through a rear gate assembly.

These provisions, together with the various ancillary provisions and features which will become apparent to those skilled in the art as the following description proceeds, are attained by the methods and assemblies of the present invention.

DETAILED DESCRIPTION OF THE EMBODIMENTS OF THE INVENTION

Figure 1:
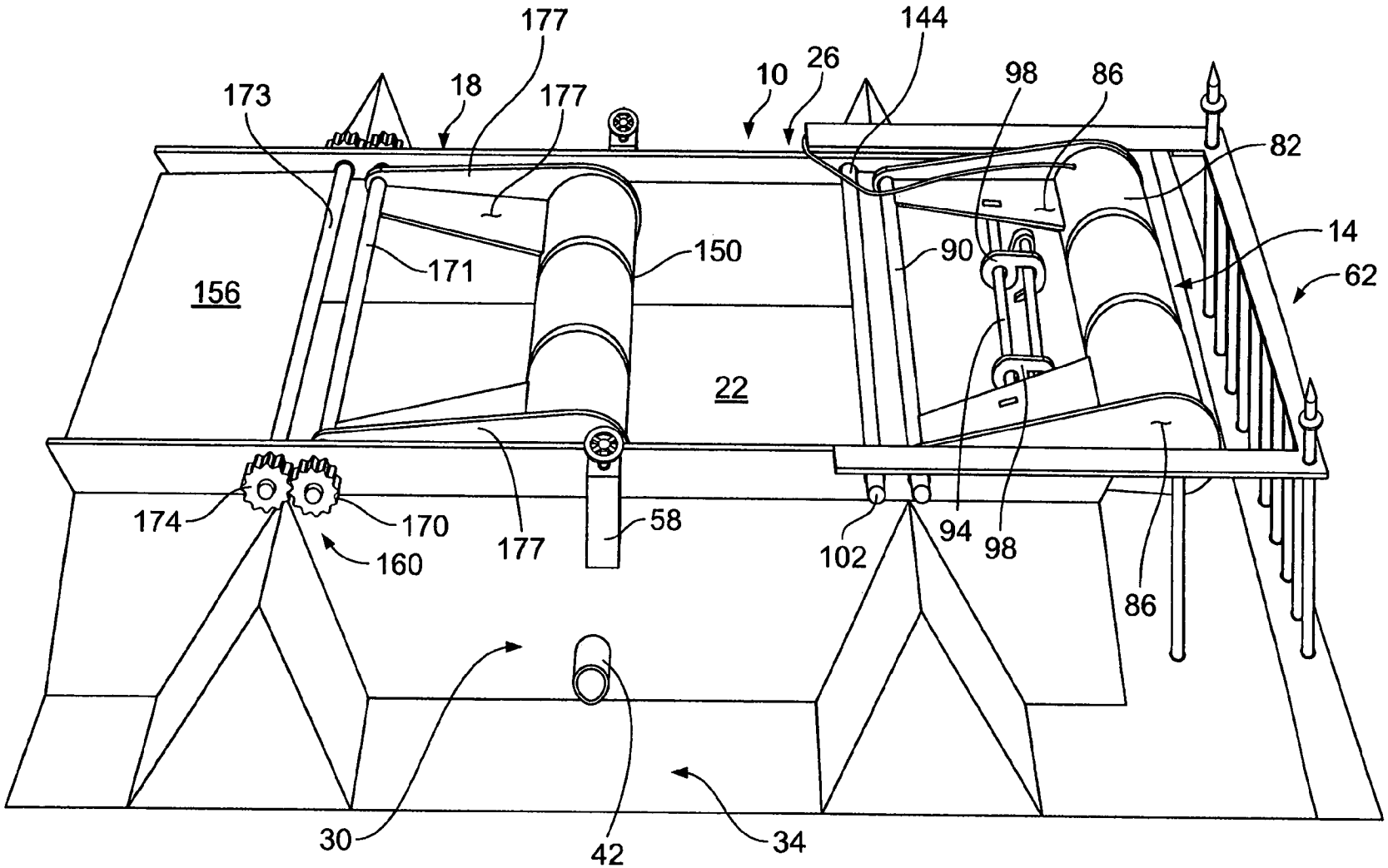
FIG. 1 is a perspective view of an embodiment of the invention wherein the front gate assembly (the gate assembly contiguous to the river) and the rear gate assembly (the gate assembly contiguous to the marsh land) are in an opened position for allowing water to flow from a water source (i.e., a river), through the aqueduct, and into the marsh land.

In the description herein, numerous specific details are provided, such as examples of components and/or methods, to provide a thorough understanding of the embodiments of the present invention. One skilled in the relevant art will recognize, however, that an embodiment of the invention may be practiced without one or more of the specific details, or with other apparatus, systems, assemblies, methods, components, materials, parts, and/or the like. In other instances, well-known structures, materials, or operations are not specifically shown or described in detail to avoid obscuring aspects of the embodiments of the present invention.

Referring in detail now to the drawings, wherein similar parts of the invention are identified by like reference numerals, there is seen an apparatus, i.e. a storm-surge aqueduct assembly, generally illustrated as 10. The aqueduct assembly 10 includes a front gate assembly 14 and a rear gate assembly 18. In operation of various embodiments of the invention, the front gate assembly 14 is typically located near a river or any other body of water that is capable of rising to a precarious level. For purpose of describing embodiments of the present invention, the front gate assembly 14 will be described as being near a river, such as the Mississippi river. The rear gate assembly 18 is typically located near a section of land that is suitable for receiving water that has been removed from the river. For various embodiments of the present invention, the land for receiving river water will be marsh land, such as land in proximity to the Mississippi river.

The aqueduct assembly 10 typically contains a bottom 22 supporting a pair of side frames 26 and 30. A flange member 34 is coupled to the side frames 26 and 30 which respectively include drainage pipes 38 and 42 that respectively terminate at internal openings 46 and 50 in the side frames 26 and 30. The side frames 26 and 30 respectively support gate valves 54 and 58 for controlling the flow of water through the respective drainage pipes 38 and 42.

Figure 2:
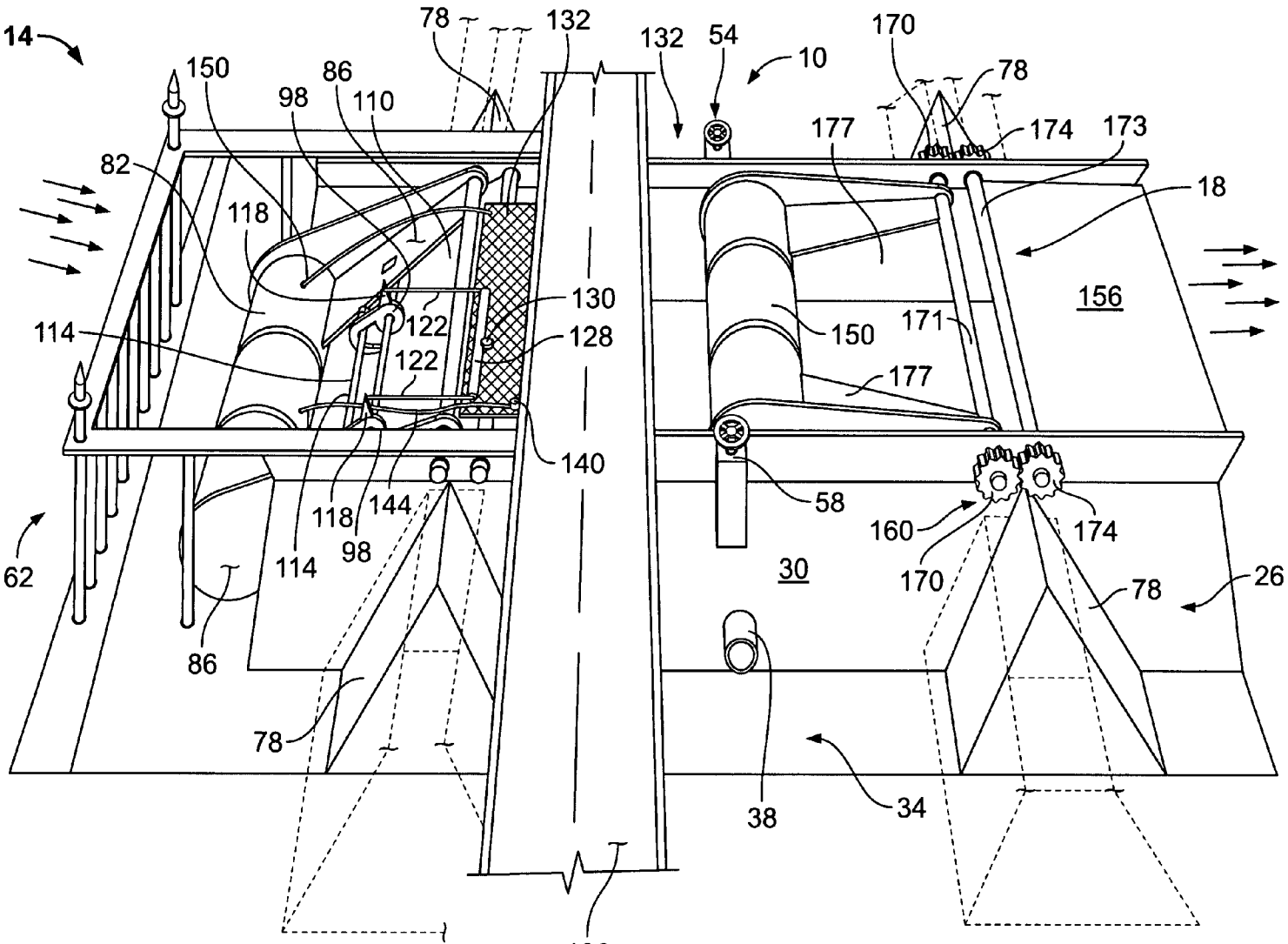
FIG. 2 is a perspective view of an embodiment of the invention showing the rear flotation device and the rear gate in an opened position, and the front gate assembly in a closed position immediately before the hooks associated with the front flotation device are decoupled from the latch bar of the front gate to allow the front flotation device to buoy upwardly while the front gate remains in a closed position, to allow water to flow through the drainage pipe and into the aqueduct, and from the aqueduct onto the marsh land.
Figure 3:
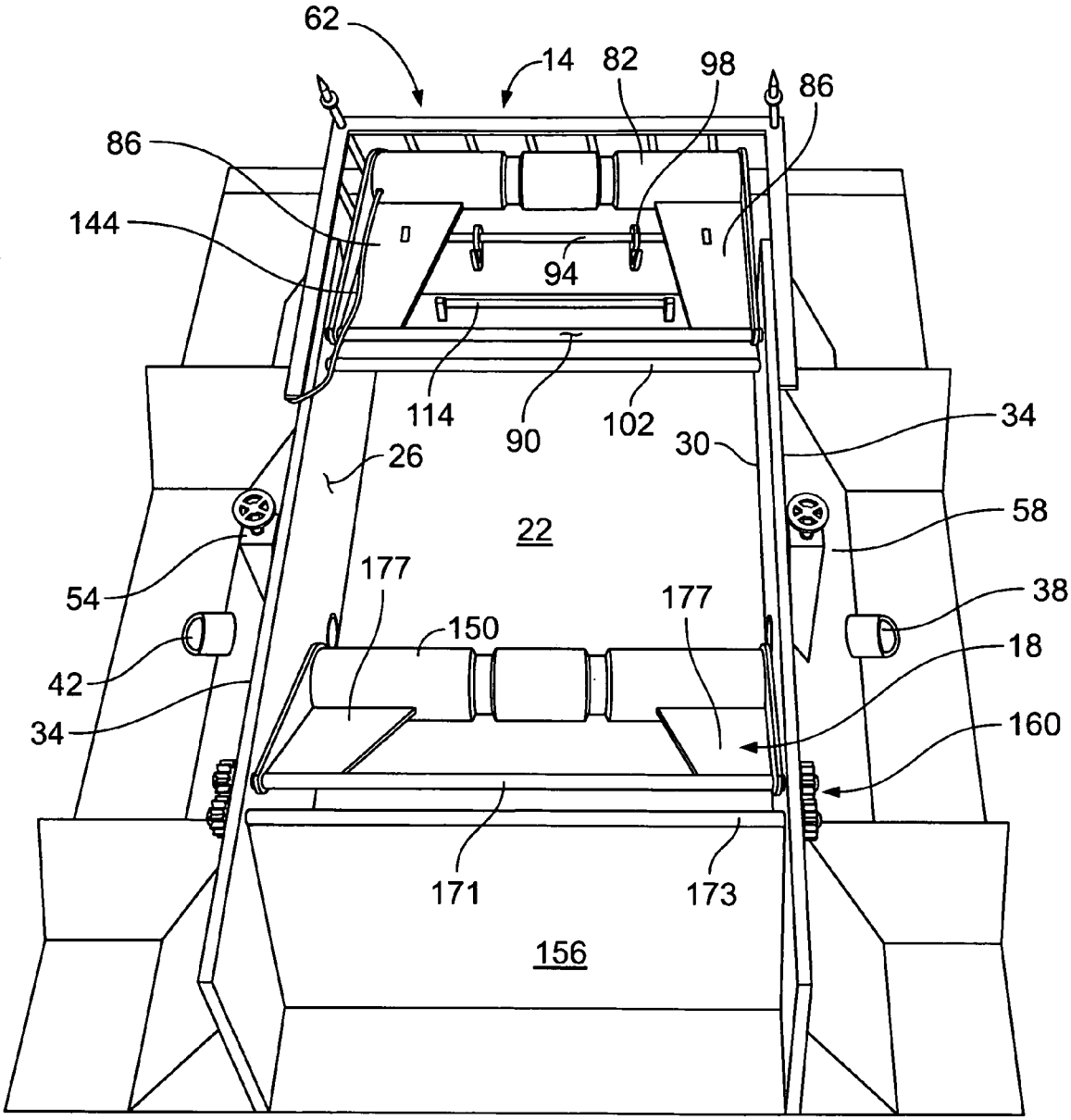
FIG. 3 is a perspective view of an embodiment of the invention from the rear gate assembly side of the aqueduct assembly showing the rear gate assembly in a closed position and the front flotation device decoupled from the latch bar of the front gate to allow the front flotation device to buoy upwardly while the front gate remains in a closed position.
Figure 9:
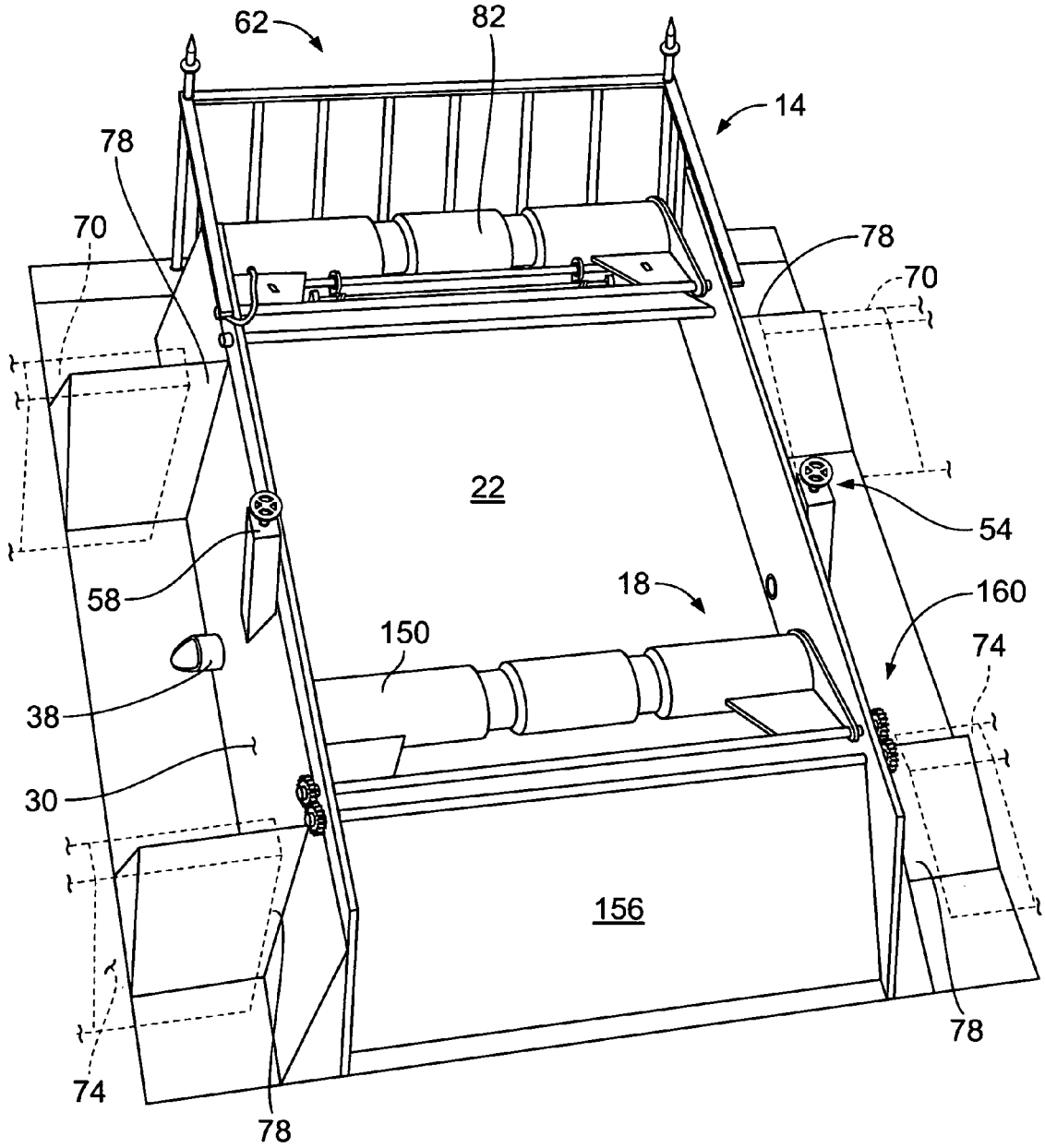
FIG. 9 is a perspective view of an embodiment of the invention from the rear gate assembly side of the aqueduct assembly showing the rear gate assembly in a closed position, and levees represented as dashed lines and in a spaced position with respect to each other.

The aqueduct assembly 10 may straddle and/or intercept levees, such as spaced levees 70 and 74 as seen in FIGS. 2 and 9. In the event that water passes over levee 70 and/or levee 74 is breached, river water will flow into the area between the levees 70 and 74. To remove water between the levees 70 and 74, after the front gate assembly 14 is closed and the rear gate assembly 18 is opened (see FIG. 10), one or both gate valves 54 and 58 are opened to allow water to flow from between the levees 70 and 74, through the respective drainage pipes 38 and 42 and into the aqueduct assembly 10, and through the open rear gate assembly 18 of the aqueduct assembly 10 into the marsh.

In another embodiment of the invention, which depends on the slope of the land behind the levee that is contiguous to the river, the aqueduct assembly 10 may be employed when only one levee exists, i.e. levee 70. For this embodiment of the invention, water collects behind levee 70 and at points that register and are longitudinally aligned with drainage pipes 38 and 42. Water would be passed into and through the open rear gate assembly 18 in accordance with the procedure (i.e., opening gate valves 54 and/or 58) that is employed for removing water between two levees, i.e., levees 70 and 74. In an embodiment where a single levee (e.g., levee 70) is employed and where assembly 10 bisects, separates or intercepts the single levee, any water seeping between the assembly 10 and the intercepted/separated section of the single levee may be removed in accordance with the procedure for removing water.

In an embodiment of the invention, levee-engager members 78 may be supported by the flange member 34 for coupling levees 70 and 74 to the aqueduct assembly 10. When the levee-engager members 78 are engaged to levees 70 and 74, the aqueduct assembly 10 is anchored into a steadfast position while simultaneously allowing the drainage pipes 30 and 42 to be in contact with any water disposed between levees 70 and 74. The levee-engager members 78 may be any suitable members which are capable of functioning for their purposes. In an embodiment of the invention, levee-engager members 78 are generally configured to the shape of a levee, such as triangular (hollow or solid) as shown in FIGS. 1, 2 and 9. In another embodiment of the invention, levee-engager members 78 are formed such that the levees lodge within levee-engager members 78, i.e., the levee-engager members 78 are formed over the levees such that levee-engager members 78 are supported by the outer surface of the levees. Members 78 may be made of any suitable material, such as concrete.

Figure 4:
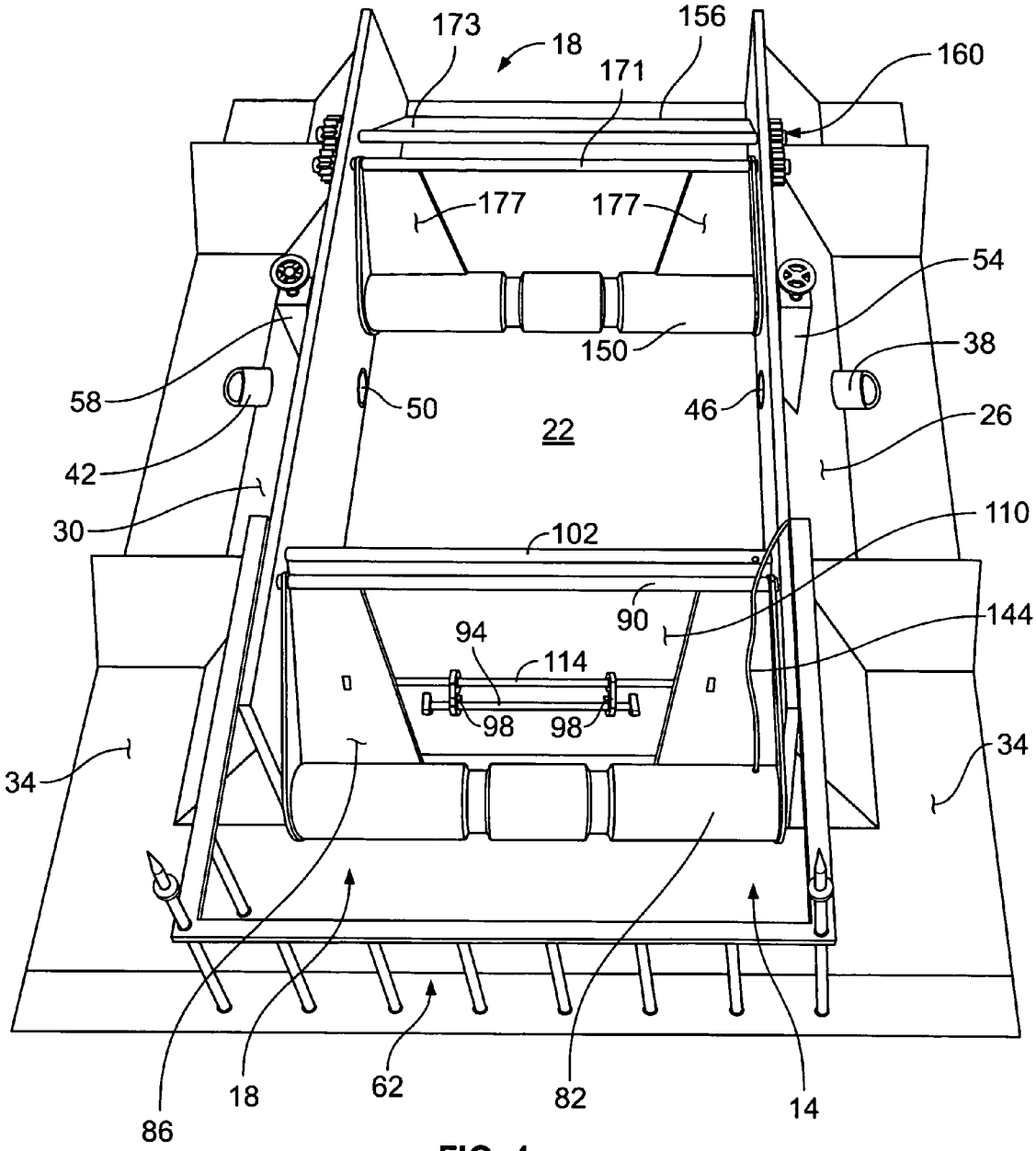
FIG. 4 is a perspective view of an embodiment of the invention from the front gate assembly side of the aqueduct assembly showing the rear gate assembly in a closed position, and the front flotation device decoupled from the latch bar of the front gate to allow the front flotation device to buoy upwardly while the front gate remains in a closed position.

In an embodiment of the invention, a protection guard assembly 62 is coupled to ends of the side frames 26 and 30, as illustrated in FIG. 4. The guard assembly 62 functions to prevent floating debris from passing from the river into the aqueduct assembly 10, which could damage the equipment of the aqueduct assembly 10.

Figure 13:
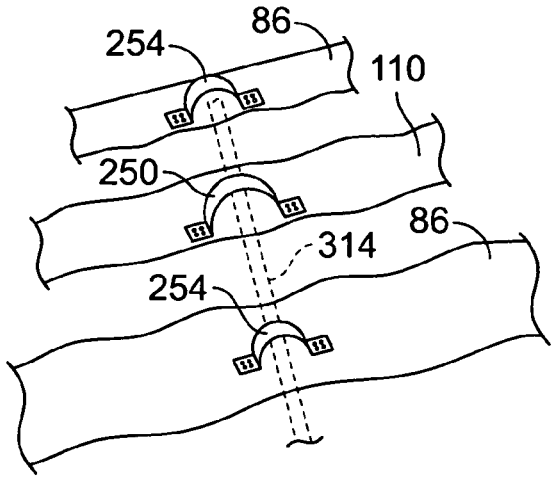
FIG. 13 is a schematic view of the hydraulic rod passing through a flotation latch, through a flood gate latch after having passed through an opening in a bracket of the front gate assembly, and through a side-wall latch which is supported by a top of a side wall or frame.
Figure 14:
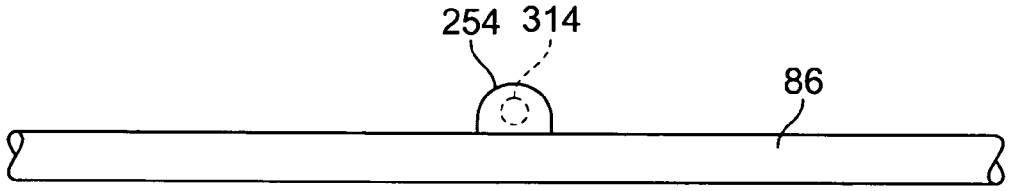
FIG. 14 is a side elevational view of a flotation bracket supporting a flotation latch where through the hydraulic rod passes for coupling the front gate assembly assembly to the flood gate.
Figure 15:
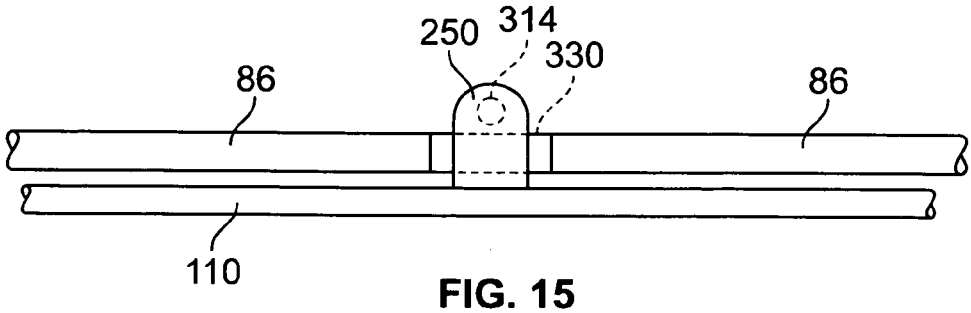
FIG. 15 is a side elevational view of a flood gate latch passing through the opening in the bracket of the front gate assembly for receiving the hydraulic rod to couple the front gate assembly (including the flotation device) to the flood gate.
Figure 16:
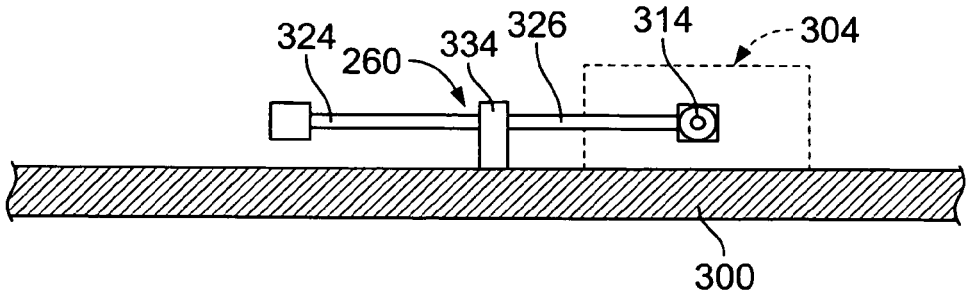
FIG. 16 is a vertical sectional view taken in direction of the arrows and along the plane of line 16-16 in FIG. 11, and illustrates the swivel assembly, and the hydraulic cylinder as dashed lines.

The front gate assembly 14 controls the passage of water into the aqueduct assembly 10 and comprises a riverside gate flotation device 82, brackets 86-86 respectively connected to opposed ends of the flotation device 82, and ends of the respective brackets 86-86 connected to rod 90 which is rotatably secured to frames 26 and 30. In an embodiment of the invention, a gate rod 102 is provided. A gate rod 102 is also rotatably secured to frames 26 and 30. Gate 110 is coupled to gate rod 102 such that as gate 110 moves (e.g., up and down) gate rod 102 rotates on frames 26 and 28. A hook-engaging rod 114 is connected to the gate 110. In an embodiment of the invention gate 110 may be secured pivotally to rod 90 (rod 102 would not be needed). In yet another embodiment of the invention, rod 90 (or rod 102) is affixed, say to frames 26 and 30, and gate 110 and flotation device 82 are pivotally coupled to rod 90 (or rod 102). More specifically, brackets, 86-86 and gate 110 pivot about rod 90 (or rod 102) while rod 90 (or rod 102) remains stationary, as best shown in FIG. 13.

The front gate assembly 14 also includes a rod 94 coupled to the brackets 86, and a pair of hooks 98-98 which are movably mounted on rod 94. As best shown in FIG. 2, each hook 98 has a lug 118 secured to it. Lugs 118-118 are respectively coupled to rods 122-122 which respectively couple to a shaft 126. Shaft 126 is operated by a hydraulic pump/motor 130 which cooperates with shaft 126, rods 122-122 and lugs 118-118 for moving or rotating the hooks 98-98 for engaging and disengaging the hook-engaging rod 114. The hydraulic pump/motor 130 is supported by a cat walk 132 which is coupled to a bridge 136 that is supported by frames 26 and 30, as illustrated in FIG. 2.

The aqueduct assembly 10 is situated at a desired elevation above the river. When hooks 98-98 are engaged to the hook-engaging rod 114, as the gate flotation device 82 rises when coming in contact with river water, the gate 110 (coupled to the flotation device 82) also rises along with the gate flotation device 82. As the river water subsides, the gate flotation device 82 commences to move downwardly from not being in contact with any river water. As the gate flotation device 82 moves downwardly, gate 110 also moves downwardly until gate 110 closes off the front gate assembly 14.

Figure 10:
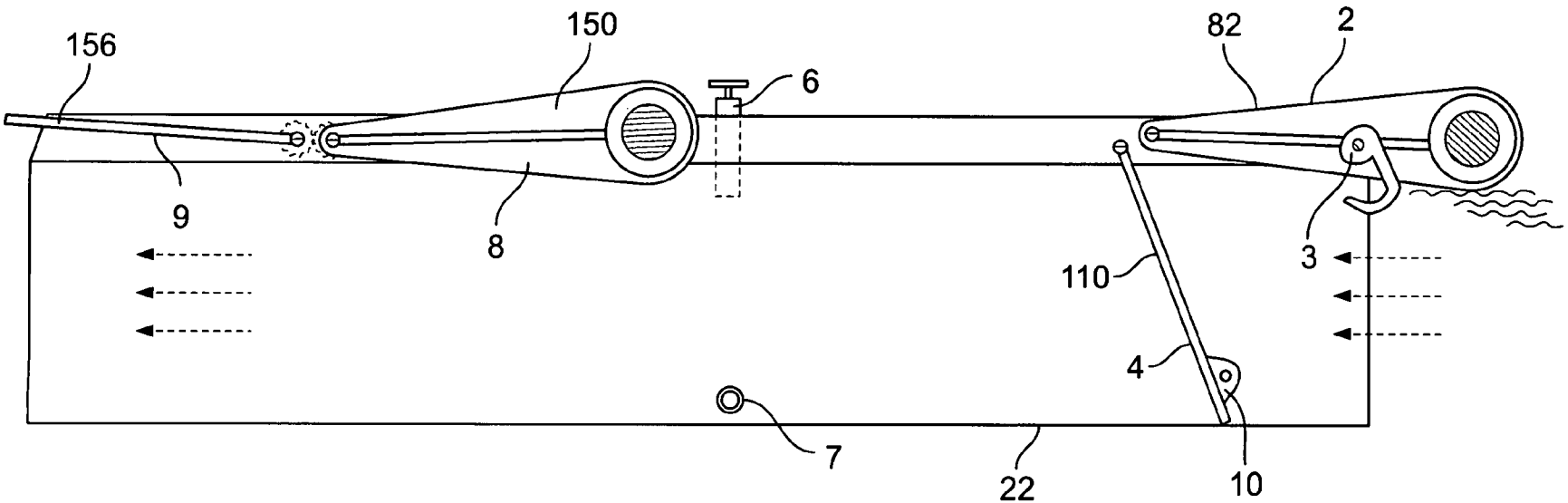
FIG. 10 is a vertical-sectional elevational view of an embodiment of the aqueduct assembly showing the front flotation device (i.e., the river side flotation device) having its associated hooks decoupled from the latch bar of the front gate (river side gate) such that the front flotation device is free to buoy upwardly while the front gate remains in a closed position, and further showing the rear flotation device (marsh side floatation device) and the rear gate (marsh side gate) in an opened position to allow water to flow through the drainage pipe and into the aqueduct, and from the aqueduct onto the marsh land.

When hooks 98-98 are disengaged from the hook-engaging rod 114, the gate flotation device 82 may rise and fall independently of gate 110, and gate 110, depending on its weight and the rate of inflow of river water through the front gate assembly 14, may (or would) sink into contact with the bottom 22, as shown in FIG. 10.

In another embodiment of the invention, the front gate assembly 14 may be closed solely with gate 110, as illustrated in FIG. 10. For this embodiment of the invention, hooks 98-98 are disengaged from the hook-engaging rod 114 of the gate 110 by the hydraulic pump/motor 130, as previously indicated. This may be done at any suitable time, such as before the river water comes in contact with front gate assembly 14, or after the river water has been in contact with the front gate assembly 14 and while the river water is still flowing through the front gate assembly 14 and into the aqueduct assembly 10.

If the hydraulic pump/motor 130 disengages hooks 98-98 from the hook-engaging rod 114 before the river water comes into sufficient contact with the front gate assembly 14, as the river water contacts the front gate assembly 14 and commences to rise, the flotation device 82 rises (independent of the gate 110) along with the rising river water, until eventually reaching the position illustrated in FIG. 10. Gate 110 remains closed, particularly from the river-water pressure against the gate 110.

Figure 6:
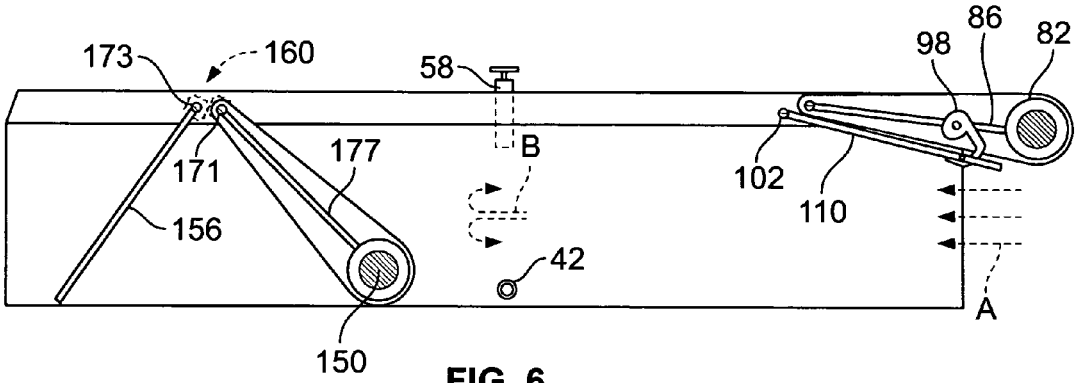
FIG. 6 is a vertical sectional view of the aqueduct assembly showing the front gate assembly after being opened by inflowing river water and the rear gate assembly a closed.
Figure 7:
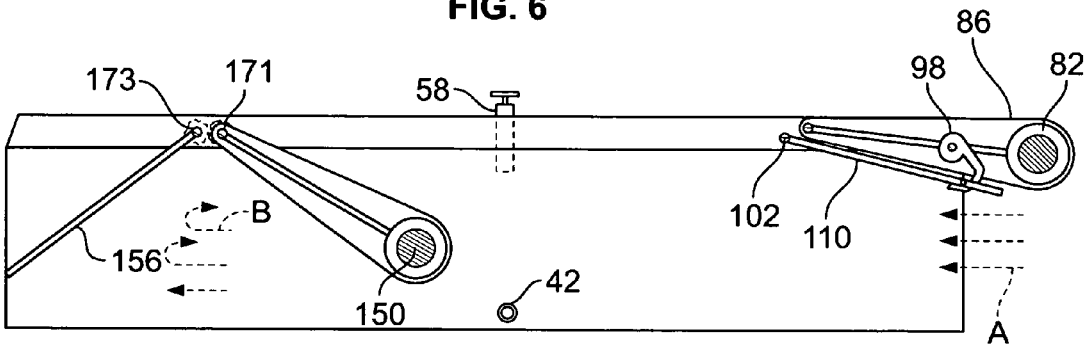
FIG. 7 is a vertical sectional view of the aqueduct assembly showing the front gate assembly in a position of being in an opened position from inflowing river water, and rear gate assembly in a position of beginning to open by inflowing river water causing the rear flotation device to start elevating which in turn causes the rear gate to start elevating.
Figure 8:
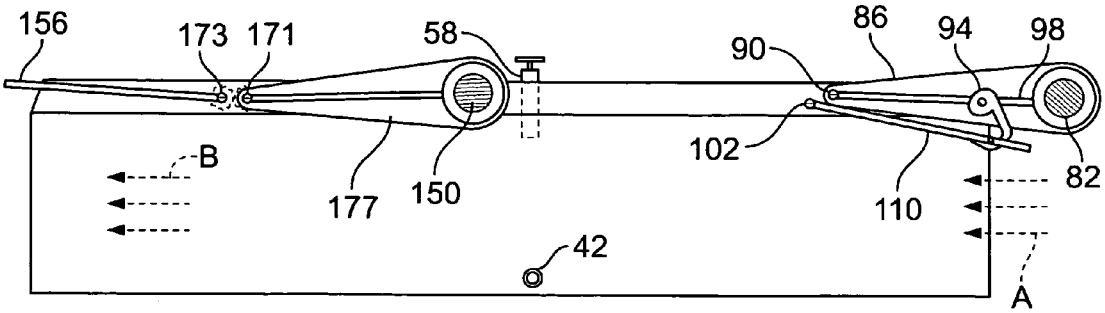
FIG. 8 is a vertical sectional view of the aqueduct assembly showing the front gate assembly and rear gate assembly in an opened position.

If the hydraulic pump/motor 130 disengages the hooks 98-98 from the hook-engaging rod 114 after the river water has been in contact with the front gate assembly 14, and after the front gate assembly 14 has been in the position illustrated in FIGS. 6-8, the gate 110 will fall independent of the flotation device 82, assuming the gate 110 has sufficient weight and the river-water pressure is not too great. The gate 110 continues to fall until eventually reaching the position illustrated in FIG. 10. The gate 110 remains closed, particularly from the river-water pressure against the gate 110.

The front gate assembly 14 of the aqueduct assembly 10 may also include a water pump 140 and a water hose 144 coupled to the water pump 140 and to the flotation device 82. A vent line 150 is conveniently coupled to the flotation device 82 for venting trapped air from within the flotation device 82 into the atmosphere.

In one embodiment of the invention, the water pump 140 may be used to add water into the flotation device 82 to prevent the flotation device 82 from rising when coming in contact with river water. The source of water may be from any suitable source, such as the river itself. When the flotation device 82 is filled with water, the flotation device 82 will not rise when coming in contact with river water due to the weight (pressure) of the river water and lack of buoyancy. Because the flotation device 82 does not rise, the gate 110 will not rise and will remain closed due to the flotation device 82 weighing more than the gate 110 and/or from the force of river water flowing against the gate 110. Alternatively, air may be used instead of water for raising or lowering the flotation device 80.

The water pump 140 may remove river water from the flotation device 82 as desired. Thus, and in another embodiment of the invention, the flotation device 82 may be caused to rise independently of the gate 110, without the gate 110 moving simultaneously with the flotation device 82, by the hydraulic pump/motor 130 disengaging the hooks 98 from the hook-engaging rod 114 (a latch bar) and removing (with the water pump 140) river water from the flotation device 82. This causes a decrease in weight, and an increase in buoyancy, of the flotation device 82, which subsequently causes the flotation device 82 to elevate while the gate 110 remains in place (see FIG. 10).

The procedure may be reversed in another embodiment of the invention; that is, the flotation device 82 may be lowered [from its position illustrated in FIG. 10] while gate 110 remains closed by water pump 140 pumping or injecting river water into the flotation device 82. When a sufficient amount of river water has been added or injected into the flotation device 82, the weight of the river water, and a decrease in buoyancy of the flotation device 82, causes the flotation device 82 to sink. When the flotation device 82 sinks into contact with the gate 110, the hydraulic pump/motor 130 may move the hooks 98 into engagement with the hook-engaging rod 114 (a latch bar) for coupling the flotation device 82 to the gate 110.

The rear gate assembly 18 is structurally similar to the front gate assembly 14 in that it includes a rear flotation device 150 and a rear gate 156 which are coupled together at their tops by a coupling assembly, generally illustrated as 160, such that when the flotation device 150 moves from rising river water within the aqueduct assembly 10, the rear gate 156 will also move simultaneously with the flotation device 150. As previously indicated, water may be released (i.e., through the front gate assembly 14) into the aqueduct assembly 10 from the river, or water (i.e. water between levees) may be released (through drainage pipes 38 and 42) into the aqueduct assembly 10 from land between two levees. When there is no more water in the aqueduct assembly 10, the rear flotation device 150 will drop which causes the rear gate 156 to drop and close the rear gate assembly 18.

The coupling assembly 160 may be any suitable coupling assembly that is capable of opening the rear gate 156 as the rear flotation device 150 pivotally elevates as the level of water in the aqueduct assembly 10 rises. In an embodiment of the invention, the coupling assembly 160 comprises a pair of flotation gears 170-170 which are respectively trained to a pair of gate gears 174-174. Gears 170-170 couple to rod 171. Brackets 177-177 couple flotation device 150 to rod 171. Gears 174-174 and rear gate 156 are coupled to rod 173.

As water passes through the drainage pipes 38 and 42, or through the front gate assembly 14, water in the aqueduct begins to rise causing the rear flotation device 150 to rise. As the rear flotation device 150 rises, gears 170 and 174 rotate accordingly, and the rear gate 156 starts rising which causes water to start exiting the aqueduct and passing on to the marsh land. As the level of water in the aqueduct begins to subside, the rear flotation device 150 begins to lower which causes the rear gate 156 to commence closing from the downwardly movement of the flotation gear device 150 being translated to the rear gate 156 through the appropriate rotation of the gears 170 and 174.

Figure 5:
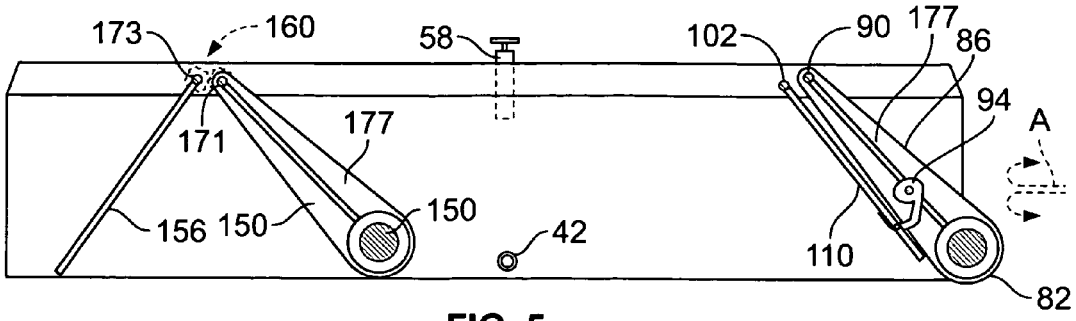
FIG. 5 is a vertical sectional view of the aqueduct assembly showing the front gate assembly and rear gate assembly in a closed position.

Referring in detail now to FIGS. 5-8 for operation of an embodiment of the invention, there is seen in FIG. 5 a vertical sectional view of the aqueduct assembly 10 showing the front gate assembly 14 and rear gate assembly 18 in a closed position. The direction of flow of river water is initially against and off the device 82/gate 110 combination, which changes the direction of flow of the river water, as represented by arrow A in FIG. 5.

In operation of an embodiment of the invention, continual flow of river water against the device 82/gate 110 combination causes the gate flotation device 82/gate 110 combination to rise to the position illustrated in FIG. 6, where the front gate assembly 14 is opened and the flow of river water through the front gate assembly 14 is in the direction of arrow A. The rear gate assembly 18 remains closed. The direction of flow of river water after passing through the front gate assembly 14 is initially against and off the device 150/gate 156 combination, which changes the direction of flow of the river water, as represented by arrow B in FIG. 6.

Continual flow of river water against the device 150/gate 156 combination causes the rear flotation device 150 to begin opening, as illustrated in FIG. 7. River water commences to flow underneath flotation device 150, and subsequently against and off gate 156, which initially changes the direction of flow of river water, as represented by arrow B in FIG. 7. As the rear flotation device 150 continues to rise from contact with river water, gate 156 continually to rise until the device 150/gate 156 combination reaches the position illustrated in FIG. 8. In this position the front gate assembly 14 and rear gate assembly 18 are opened, and the flow of river water through front gate assembly 14 is in direction of arrow A and the flow of river water through the rear gate assembly 18 is in direction of arrow B. As previously indicated, flotation device 82 may be bound to a single rod, such as rod 90, and gate 110 may be pivotally secured to the single rod.

Figure 11:
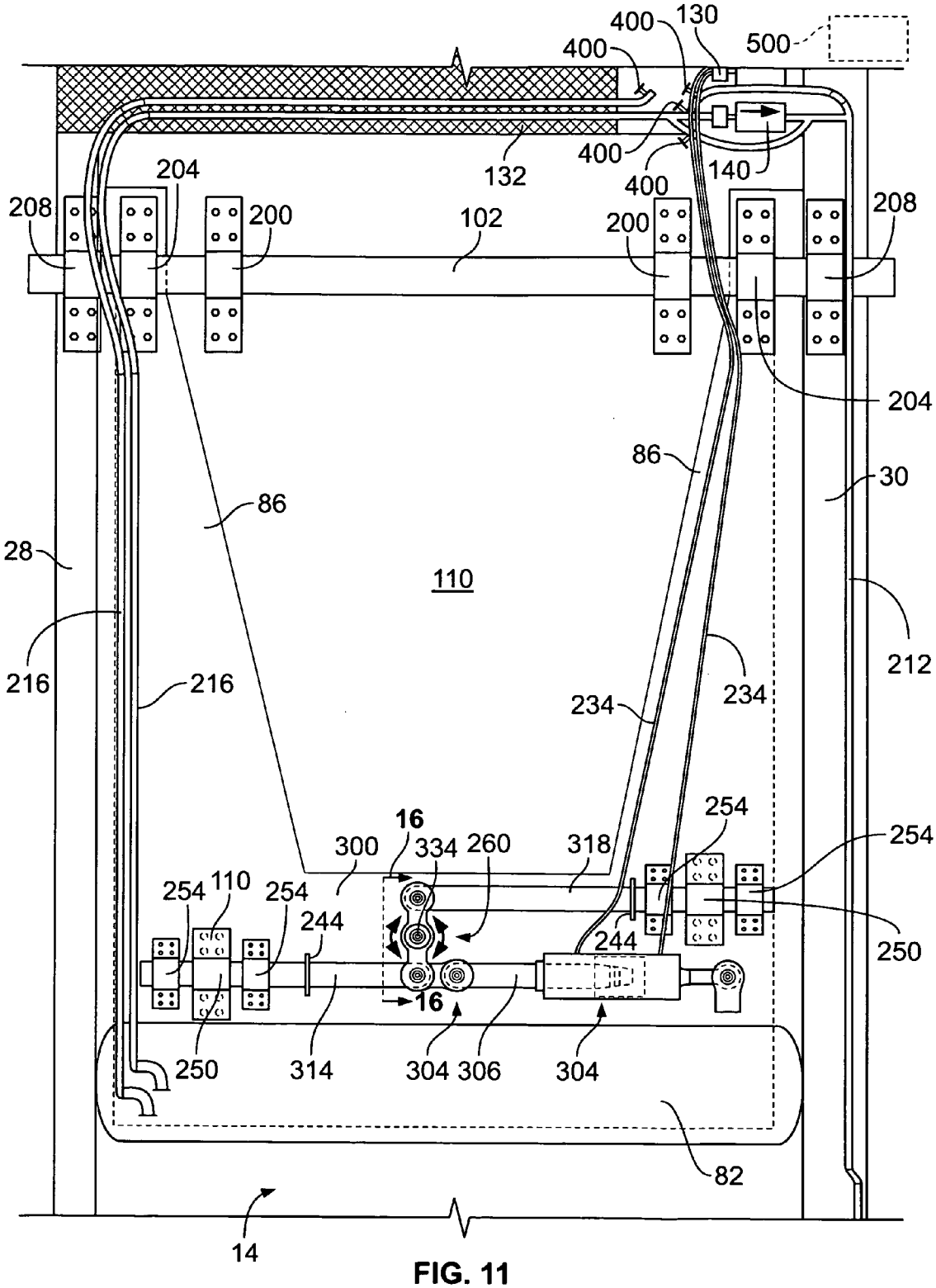
FIG. 11 is a top plan schematic view of the front gate assembly (including flotation device) and flood gate pivotally secured to a common rod, and the flood gate coupled to the front gate assembly (i.e., brackets of the front gate assembly) by a hydraulic rod of a hydraulic assembly passing through flotation latches and a flood-gate latch after the flood-gate latch has passed through an opening in the brackets of the front gate assembly.
Figure 12:
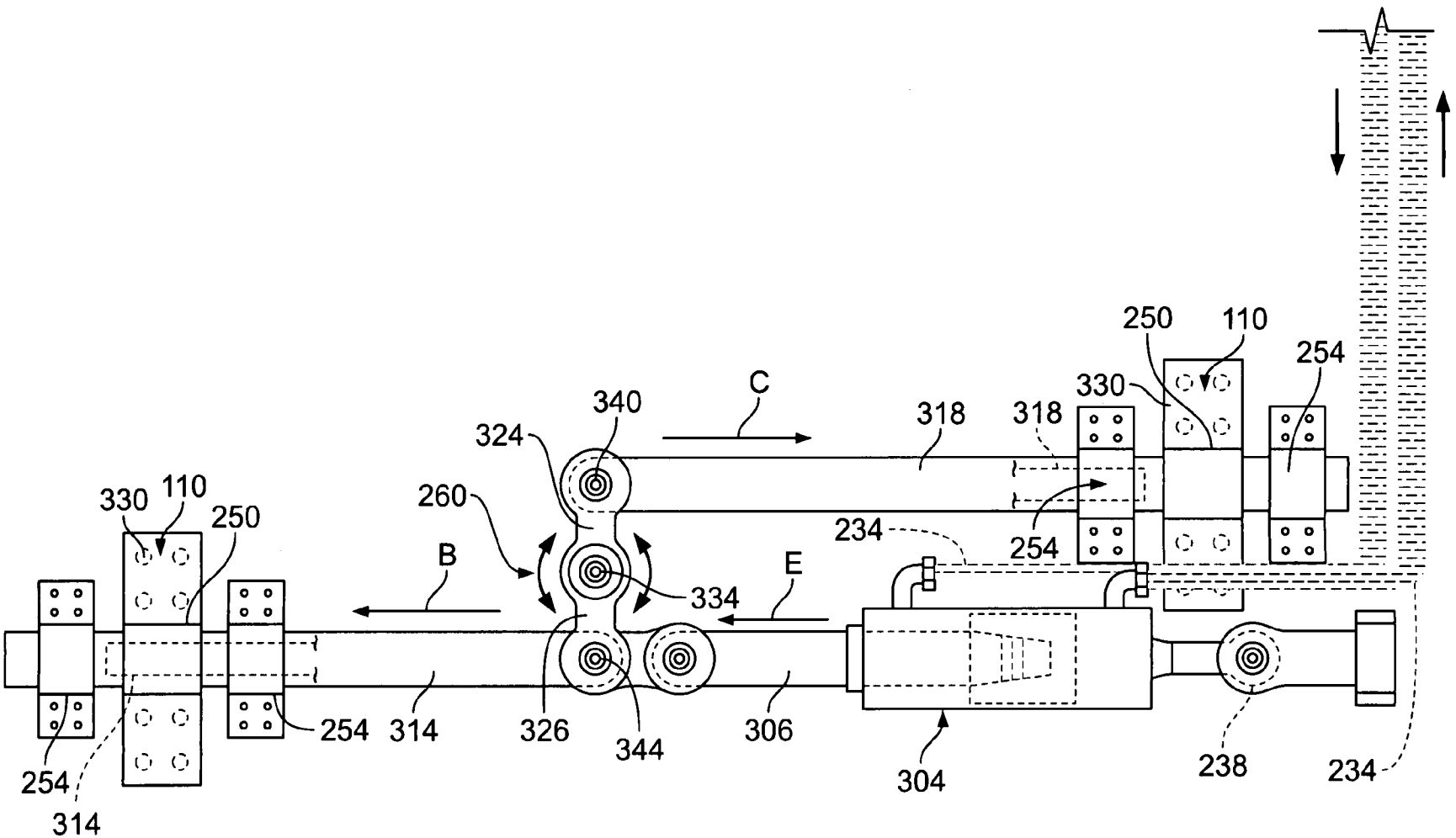
FIG. 12 is a top plan view of the swivel assembly and hydraulic assembly.

Referring now to FIGS. 11-16 for another embodiment of the invention, there is seen the front gate 110 having coupled thereto a pair of couplers or latches [clamps, inverted U-shaped bracket, etc] 200-200. Another pair of couplers or latches 204-204 is mounted to the brackets 86-86. The top of the side frames or walls 28 and 34 respectively support couplers or latches 208-208 for stationarily securing the ends of the rod 102. Latches 200-200 and 204-204 are capable of rotatively moving on and around rod 102 such as to provide freedom for the front gate 110 and the front gate assembly 14 (including flotation device 82) to rotatively move and/or pivot up and down for closing and opening the front gate assembly 14 including the front gate 110. FIG. 11 is a top plan schematic view of the front gate assembly 14 (including flotation device 82) and flood gate 110 pivotally secured to rod 102.

Integrally bound to brackets 86-86 is an intermediate bracket 300 which is coupled to the flotation device 82, along with brackets 86-86. The intermediate bracket 300 supports an hydraulic assembly which includes a hydraulic ram assembly 304 having a piston 306, a pad-eye stop 238 coupled to the intermediate bracket 300 for supporting an end of the hydraulic ram assembly 304, and a pair of latching pins or rods 314 and 318. Latching pin or rod 314 is directly engaged to the hydraulic ram assembly 304. A pair of ball joints 244 and 244 is shown to respectively hold rods 314 and 318 in correct alignment.

In addition to latches 200-200, 204-204, and latches 208-208, various embodiments of the invention include couplers or latches 254-254-254-254 which are secured to the brackets 86-86 [and/or intermediate bracket 300]. Latches 250-250 are secured to flood gate 110 and respectively pass through openings 330-330 in brackets 86-86. Movement of a swivel assembly 260 couples brackets 86-82 [and flotation device 82] of the front gate assembly 14 to the front gate 110.

The swivel assembly 260 comprises a pair of swivel arms 324 and 326 which are coupled at an intermediate swivel point 330 that is defined by an upstanding pin 334 which is affixed to the intermediate bracket 300. Arms 324 and 326 respectively couple to rods 318 and 314 at swivel connections 340 and 344. With respect to the top plan view in FIG. 12, when the piston 306 is moved by the hydraulic ram assembly 304 in direction of the arrow E (see FIG. 12), swivel connections 340 and 344 and swivel arm 324 and 326 are respectively moved clockwise, which causes rods 318 and 314 to respectively move in direction of arrows C and B from their respective dashed line positions, the position when flood gate 110 is not coupled to the front gate assembly 14 (i.e., brackets 86-86 of the front gate assembly 14). Continual movement of rods 318 and 314 causes them to further respectively move through latches 250-250 which have been previously passed through openings 330-330 in brackets 86-86 by movement of the flotation device 82.

As seen in FIG. 11, a water pump 140 is coupled to a water line 212 leading to a river and is further coupled to water lines 216-216 for filling and discharging water from the flotation device 82. Hydraulic pump 130 is coupled to hydraulic ram assembly 304 via hydraulic lines 234-234 for controlling the movement of piston 306 via the hydraulic ram assembly 304. Valves 400 may be conveniently disposed as desired. Pumps 130 and 140 are typically manually operated. Pumps 130 and 140 may also be controlled by a computer system 500, which may be located at any suitable location.

In operation of the invention, rods 314 and 318 are moved by the hydraulic ram assembly 304 in combination with the swivel assembly 260 for coupling and decoupling the flood gate 110 to the front gate assembly 14 including the flotation device 82. As previously indicated, movement of the flotation device 82 [and brackets 86-86] towards the flood gate 110 [and latches 250-250] may be controlled by a pump. As further previously indicated, movement of the flotation device 82 towards flood gate 110 and its associated latches 250 may be controlled (e.g., manually controlled) by water [and/or air via a pneumatic pump, not show] being introduced and withdrawn from the flotation device 82 via water pump 140 pumping water through lines 216.

In further operation of the invention and as previously indicated, when piston 306 is moved by the hydraulic ram assembly 304 in direction of the arrow E (see FIG. 12), swivel connections 340 and 344 and swivel arm 324 and 326 are respectively moved clockwise, which causes rods 318 and 314 to respectively move in direction of arrows C and B from their respective dashed line positions, the position when flood gate 110 is not coupled to the front gate assembly 14 (i.e., brackets 86-86 of the front gate assembly 14). Continual movement of rods 318 and 314 causes them to further respectively move through latches 250-250 which have been previously passed through openings 330-330 in brackets 86-86 by movement of the of the flotation device 82.

When piston 306 is moved by the hydraulic ram assembly 304 in opposite direction of the arrow E (see FIG. 12), swivel connections 340 and 344 and swivel arm 324 and 326 are respectively moved counter clockwise, which causes rods 318 and 314 to respectively move in opposite direction of arrows C and B toward their respective dashed line positions, the position when flood gate 110 is not coupled to the front gate assembly 14 (i.e., brackets 86-86 of the front gate assembly 14). Continual movement of rods 318 and 314 causes them to further respectively move out of engagement with latches 250-250 and into their respective dashed lines position. Rods 318 and 314 had been previously disposed through openings 330-330 in brackets 86-86 by movement of brackets 86-86 into contact with flood gate 110.

In another embodiment of the invention, the rear flotation device 150 and the rear gate 156 in combination and operation, may include all components of the front gate assembly 14 illustrated in FIGS. 11-16, such as the hydraulic ram assembly (304), the latches [clasps], the rods, swivel assembly (260), and openings [in the brackets] of the rear flotation assembly, The rear flotation device and rear gate would operate [and be operated] essentially identically to the procedure for the front gate assembly 14.

Practices of embodiments of the present invention provide a storm-surge diversion assembly that will alleviate or eliminate water pressure against levees. In an embodiment of the invention, the storm-surge aqueduct assembly is strategically placed in proximity to the mouth of a river. For some embodiments of the invention, no personnel would be needed to operate the assembly during a hurricane. When the water level in the river rises, the front flotation device will lift the front gate assembly to allow water to flow into the aqueduct. As water flows into the aqueduct, the rear or back gate assembly rises to allow water to flow from the aqueduct into marsh lands.

The storm-surge aqueduct assembly may be employed in any suitable manner. By way of example only and for an embodiment of the invention, the storm-surge aqueduct assembly may include two pairs of water-directing spaced petitions which respectively protrude from sides of the storm-surge assembly. Each pair of petitions may respectively align with each pair of levees in a two levee system where the levees are spaced from each other at essentially the same distance as the water-containing petitions are spaced from each other. In the event water breaches the levee nearest the river, the water may be contained between the breached front levee and the rear of back levee.

Reference throughout this specification to "one embodiment", "an embodiment", or "a specific embodiment" means that a particular feature, structure, or characteristic described in connection with the embodiment is included in at least one embodiment of the present invention and not necessarily in all its embodiments. Therefore, the respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Additionally, any arrows in the drawings/figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of the illustrated embodiments of the present invention and are to be included within the spirit and scope of the present invention.

Therefore, while the present invention has been described herein with reference to the particular embodiments thereof, a latitude of modification, various changes and substitutions are intended in the foregoing disclosures, and it will be appreciated that in some instances some features of the embodiments of the invention will be employed without the corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

What is claimed is:

1. An aqueduct assembly comprising an aqueduct structure for intermittently containing and for allowing the passage of water from a body of water to a desired location; a front gate assembly movable coupled to the aqueduct structure so as to control the amount of water entering the aqueduct structure; a rear gate assembly movably coupled to the aqueduct structure for controlling the amount of water exiting the aqueduct structure; said front gate assembly including a front flotation assembly pivotally secured to the aqueduct structure and adapted for being coupled and decoupled to a front door for controlling the flow of water into the aqueduct structure; said rear gate assembly comprises a rear flotation assembly pivotally secured to the aqueduct structure, and a rear door pivotally secured to the aqueduct structure.

2. The aqueduct assembly of claim 1 additionally comprising a means for coupling and decoupling the front door to the front flotation assembly.

3. The aqueduct assembly of claim 1 additionally comprising at least one latch secured to the front door.

4. The aqueduct assembly of claim 1 wherein said front flotation assembly includes at least one opening where through a latch passes for coupling and decoupling the front door with the front flotation assembly.

5. The aqueduct assembly of claim 1 additionally comprising a swivel assembly mounted on the front flotation assembly and coupled to a means for coupling and decoupling the front door to the front flotation assembly.

6. The aqueduct assembly of claim 5 additionally comprising a pair of rods coupled to the swivel assembly, said rods adapted of being moved in opposite directions by the means for coupling and decoupling.

7. The aqueduct assembly of claim 1 wherein said rear flotation assembly and said rear door pivot on the aqueduct structure in opposite directions.

8. The aqueduct assembly of claim 1 wherein said rear door and said front door pivot on the aqueduct structure in opposite directions.

9. The aqueduct assembly of claim 1 wherein said front flotation assembly and said rear flotation assembly pivot on the aqueduct structure in the same direction.

10. The aqueduct assembly of claim 1 additionally comprising a pump member for pumping a matter into a flotation device of the front flotation assembly.

11. The aqueduct assembly of claim 1 additionally comprising at least one value member supported by the aqueduct structure for allowing water to flow into the aqueduct structure between the front gate assembly and the rear gate assembly.

12. The aqueduct assembly of claim 1 additionally comprising a swivel assembly mounted on the front flotation assembly, a hydraulic ram assembly coupled to the swivel assembly, and a hydraulic pump coupled to the hydraulic ram assembly.

13. A method for diverting water from a body of water onto land comprising the steps of elevating a front gate assembly for allowing water to flow into an aqueduct assembly, and subsequently elevating a rear gate assembly for permitting water to flow out of the aqueduct assembly, said elevating the rear gate assembly comprises elevating a rear door and a rear flotation assembly; and said method additionally comprises pumping a matter into a front flotation device of a front flotation assembly.

14. The method for diverting water of claim 13 additionally comprising moving a pair of rods in opposite directions for causing a front door to be coupled and decoupled from the front flotation assembly.

15. The method of claim 13 further comprising disengaging a said front flotation assembly from a front gate.

16. The method of claim 13 said elevating a rear door and a rear flotation assembly comprises pivoting the rear door and the rear flotation assembly on a aqueduct structure in opposite directions.

17. The method of claim 13 wherein said elevating a front gate assembly comprises elevating a front door and the front flotation assembly.

18. The method of claim 17 wherein said elevating a front door and the front flotation assembly comprises pivoting the front door and the front flotation assembly on an aqueduct structure in the same direction.

19. The method of claim 13 wherein said matter is selected from the group of matter consisting of water, air, and mixtures thereof.

20. A method for diverting water from a body of water onto land comprising the steps of elevating a front gate assembly for allowing water to flow into an aqueduct assembly, and subsequently elevating a rear gate assembly for permitting water to flow out of the aqueduct assembly, said elevating the rear gate assembly comprises elevating a rear door and a rear flotation assembly; and said method additionally comprises withdrawing a matter from a front flotation device of a front flotation assembly.

* * * * *